US010199134B2

(12) United States Patent
Marui et al.

(10) Patent No.: US 10,199,134 B2
(45) Date of Patent: Feb. 5, 2019

(54) ELECTRICALLY CONDUCTIVE RUBBER COMPOSITION, AND DEVELOPING ROLLER

(71) Applicant: SUMITOMO RUBBER INDUSTRIES, LTD., Kobe-shi, Hyogo (JP)

(72) Inventors: Takashi Marui, Kobe (JP); Yoshihisa Mizumoto, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 420 days.

(21) Appl. No.: 14/843,406

(22) Filed: Sep. 2, 2015

(65) Prior Publication Data

US 2016/0077463 A1 Mar. 17, 2016

(30) Foreign Application Priority Data

Sep. 17, 2014 (JP) ..... 2014-189057

(51) Int. Cl.
*H01B 1/24* (2006.01)
*G03G 15/08* (2006.01)

(52) U.S. Cl.
CPC ..... *H01B 1/24* (2013.01); *G03G 15/0818* (2013.01)

(58) Field of Classification Search
CPC ..... H01B 1/04; H01B 1/24; G03G 15/0818
See application file for complete search history.

(56) References Cited

U.S. PATENT DOCUMENTS

| | | | | |
|---|---|---|---|---|
| 8,744,324 | B2 | 6/2014 | Mizumoto et al. | |
| 2012/0014723 | A1 | 1/2012 | Mizumoto et al. | |
| 2012/0129667 | A1* | 5/2012 | Mizumoto ..... | G03G 15/1685 492/18 |
| 2016/0280894 | A1* | 9/2016 | Miyamoto ..... | C08L 19/003 |

FOREIGN PATENT DOCUMENTS

| | | | |
|---|---|---|---|
| JP | 2010-240974 | A | 10/2010 |
| JP | 4981160 | B2 | 7/2012 |
| JP | 5419958 | B2 | 2/2014 |

* cited by examiner

*Primary Examiner* — Mark Kopec
*Assistant Examiner* — Jaison P Thomas
(74) *Attorney, Agent, or Firm* — Birch, Stewart, Kolasch & Birch, LLP

(57) ABSTRACT

The present invention provides an electrically conductive rubber composition of an electron conductive type which contains neither an expensive ion conductive rubber having a higher environmental dependence nor a softening agent and a liquid rubber which are liable to increase the compression set of a developing roller or contaminate a photoreceptor body, and is usable for production of a more flexible developing roller. The present invention also provides a developing roller produced by using the rubber composition. The electrically conductive rubber composition contains a rubber component including an EPDM and an NBR and/or an SBR, sulfur, a thiazole crosslinking accelerating agent, tetramethylthiuram monosulfide and tetrabutylthiuram disulfide. The developing roller (1) is formed from the electrically conductive rubber composition.

12 Claims, 1 Drawing Sheet

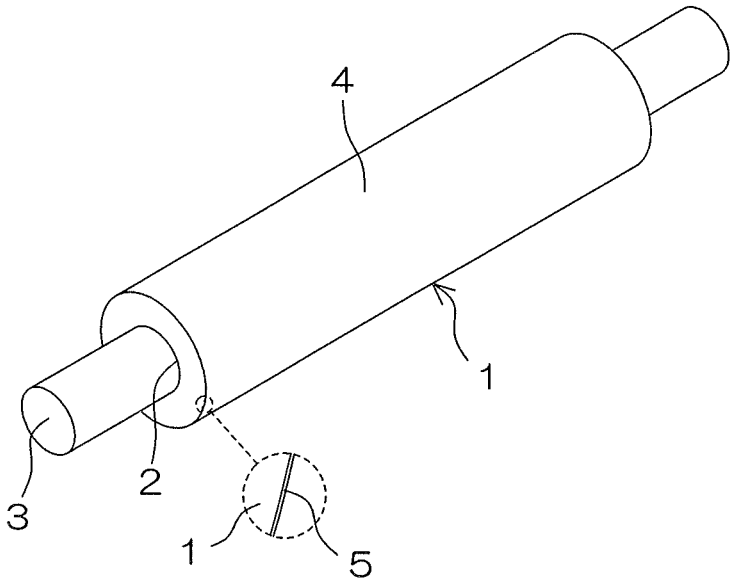
4
1
3
2
1
5

ELECTRICALLY CONDUCTIVE RUBBER COMPOSITION, AND DEVELOPING ROLLER

TECHNICAL FIELD

The present invention relates to an electrically conductive rubber composition, and to a developing roller produced by employing the electrically conductive rubber composition.

BACKGROUND ART

In an electrophotographic image forming apparatus such as a laser printer, an electrostatic copying machine, a plain paper facsimile machine or a printer-copier-facsimile multifunction machine, an image is generally formed on a surface of a sheet such as a paper sheet or a plastic film through the following process steps.

First, a surface of a photoreceptor body having photoelectric conductivity is evenly electrically charged and, in this state, exposed to light, whereby an electrostatic latent image corresponding to an image to be formed on the sheet is formed on the surface of the photoreceptor body (charging step and exposing step).

Then, toner (minute color particles) preliminarily electrically charged at a predetermined potential is brought into contact with the surface of the photoreceptor body. Thus, the toner selectively adheres to the surface of the photoreceptor body according to the potential pattern of the electrostatic latent image, whereby the electrostatic latent image is developed into a toner image (developing step).

Subsequently, the toner image is transferred onto the surface of the sheet (transfer step), and fixed to the surface of the sheet (fixing step). Thus, the image is formed on the surface of the sheet.

Further, a part of the toner remaining on the surface of the photoreceptor body after the transfer of the toner image is removed, for example by a cleaning blade or the like (cleaning step). Thus, the photoreceptor body is ready for the next image formation.

In the developing step out of the aforementioned process steps, a developing roller is used for developing the electrostatic latent image formed on the surface of the photoreceptor body into the toner image.

A known developing roller is produced, for example, by preparing an ion conductive rubber composition containing an ion conductive rubber such as an epichlorohydrin rubber as a rubber component, forming the rubber composition into a tubular body, and crosslinking the rubber component of the tubular body (Patent Document 1 and the like).

However, the electrical conductivity of the ion conductive developing roller is highly environment-dependent. Particularly, the ion conductive developing roller has significantly different resistances in a higher temperature and higher humidity environment and in a lower temperature and lower humidity environment. Therefore, the ion conductive developing roller is liable to cause imaging failure due to a difference in environment.

Since the ion conductive rubber such as the epichlorohydrin rubber is expensive, the cost reduction of the developing roller is difficult.

For the cost reduction and the suppression of the environmental dependence, it is contemplated to use an electron conductive agent such as electrically conductive carbon black in combination with a reduced proportion of the ion conductive rubber, or to use only the electron conductive agent without the use of the ion conductive rubber to impart the developing roller with electron conductivity.

If the electron conductive agent such as the electrically conductive carbon black is added to the rubber composition, however, the developing roller is liable to become less flexible to have a higher hardness. This may cause additional problems.

More specifically, the developing roller is liable to degrade the toner to reduce imaging durability, or is liable to have a reduced nip width when being in press contact with the surface of the photoreceptor body. Therefore, a formed image is liable to have a lower image quality.

The term "imaging durability" is defined as an index that indicates how long the image formation quality can be properly maintained when the same toner is repeatedly used for the image formation.

A very small part of toner contained in a developing section of the image forming apparatus is used in each image forming cycle, and the remaining major part of the toner is repeatedly circulated in the developing section. Since the developing roller is provided in the developing section and repeatedly brought into contact with the toner, whether or not the developing roller can prevent damage to the toner is a key factor to the improvement of the imaging durability. If the imaging durability is reduced, the formed image is liable to have white streaks in its black solid portion or have fogging in its marginal portion, thereby having a lower image quality.

To cope with this, it is contemplated to add a softening agent such as an oil or a plasticizer, or to use a liquid rubber such as a liquid nitrile rubber in combination with other rubber as the rubber component (Patent Document 2) to improve the flexibility of the developing roller.

However, the use of the softening agent and the liquid rubber is liable to increase the compression set of the developing roller. The developing roller having a greater compression set is liable to suffer from so-called permanent compressive deformation. That is, when the developing roller is kept in press contact with the photoreceptor body during the stop of the image forming apparatus and then is rotated to be brought out of the press contact, for example, the press contact portion of the developing roller is not restored to its original state. This may result in imaging failure such as uneven image.

Particularly, when the developing roller is incorporated in a developing unit of the image forming apparatus and kept in contact with the surface of the photoreceptor body for a longer period of time in the higher temperature and higher humidity environment in a storage test, for example, the softening agent is liable to bleed on the developing roller. The bleeding softening agent is liable to contaminate the photoreceptor body to cause imaging failure (e.g., a contamination line occurs in a formed image).

The liquid rubber is less liable to contaminate the photoreceptor body due to bleeding thereof, because the liquid rubber is crosslinked with the other rubber of the rubber component. However, an uncrosslinked lower molecular weight component and an oil component contained in the liquid rubber is liable to bleed. This may cause the contamination.

CITATION LIST

Patent Document

Patent Document 1: JP5419958
Patent Document 2: JP4981160

SUMMARY OF THE INVENTION

Problem to be Solved by the Invention

It is an object of the present invention to provide an electrically conductive rubber composition of an electron conductive type which is usable for production of a more flexible developing roller and contains neither the highly environment-dependent and expensive ion conductive rubber nor the softening agent and the liquid rubber which are liable to increase the compression set of the developing roller and contaminate the photoreceptor body, and to provide a developing roller produced by using the rubber composition.

Solution to Problem

According to the present invention, there is provided an electrically conductive rubber composition, which contains a rubber component, an electron conductive agent, sulfur as a crosslinking agent, and a crosslinking accelerating agent, wherein the rubber component includes an ethylene propylene diene rubber, and at least one selected from the group consisting of an acrylonitrile butadiene rubber and a styrene butadiene rubber, wherein the ethylene propylene diene rubber is present in a proportion of not less than 10 parts by mass and not greater than 70 parts by mass based on 100 parts by mass of the overall rubber component, wherein the sulfur is present in a proportion of not less than 0.5 parts by mass and not greater than 1.5 parts by mass based on 100 parts by mass of the overall rubber component, wherein the crosslinking accelerating agent includes not less than 1.0 part by mass and not greater than 2.0 parts by mass of a thiazole crosslinking accelerating agent, not less than 0.1 part by mass and not greater than 0.5 parts by mass of tetramethylthiuram monosulfide, and not less than 0.2 parts by mass and not greater than 1.5 parts by mass of tetrabutylthiuram disulfide based on 100 parts by mass of the overall rubber component.

The present invention also provides a developing roller formed from the inventive electrically conductive rubber composition.

Effects of the Invention

The inventive electrically conductive rubber composition containing the specific rubber component, the electron conductive agent, the sulfur and the specific crosslinking accelerating agent in the predetermined proportions is of an electron conductive type which contains neither the highly environment-dependent and expensive ion conductive rubber nor the softening agent and the liquid rubber which are liable to increase the compression set of the developing roller and contaminate the photoreceptor body, and is usable for production of a more flexible developing roller. The inventive developing roller is produced by using the inventive rubber composition.

BRIEF DESCRIPTION OF THE DRAWING

The FIGURE is a perspective view illustrating an exemplary developing roller according to one embodiment of the present invention.

EMBODIMENTS OF THE INVENTION

«Electrically Conductive Rubber Composition»

The inventive electrically conductive rubber composition contains a rubber component, an electron conductive agent, sulfur as a crosslinking agent, and a crosslinking accelerating agent. The rubber component includes an ethylene propylene diene rubber (hereinafter sometimes abbreviated as "EPDM"), and at least one selected from the group consisting of an acrylonitrile butadiene rubber (hereinafter sometimes abbreviated as "NBR") and a styrene butadiene rubber (hereinafter sometimes abbreviated as "SBR"). The EPDM is blended in a proportion of not less than 10 parts by mass and not greater than 70 parts by mass based on 100 parts by mass of the overall rubber component. The sulfur is blended in a proportion of not less than 0.5 parts by mass and not greater than 1.5 parts by mass based on 100 parts by mass of the overall rubber component. The crosslinking accelerating agent includes not less than 1.0 part by mass and not greater than 2.0 parts by mass of a thiazole crosslinking accelerating agent, not less than 0.1 part by mass and not greater than 0.5 parts by mass of tetramethylthiuram monosulfide, and not less than 0.2 parts by mass and not greater than 1.5 parts by mass of tetrabutylthiuram disulfide based on 100 parts by mass of the overall rubber component.

<Rubber Component>

The EPDM and at least one selected from the group consisting of the NBR and the SBR are used as the rubber component. That is, the rubber component is limited to a three-rubber combination of the EPDM, the NBR and the SBR, a two-rubber combination of the EPDM and the NBR, and a two-rubber combination of the EPDM and the SBR. Other rubbers such as an ion conductive rubber are not blended. However, two or more types of NBRs and/or SBRs may be used in combination with two or more types of EPDMs.

(EPDM)

Usable as the EPDM are various EPDMs each prepared by introducing double bonds into a main chain thereof by employing a small amount of a third ingredient (diene) in addition to ethylene and propylene. A variety of EPDM products containing different types of third ingredients in different amounts are commercially available. Typical examples of the third ingredients include ethylidene norbornene (ENB), 1,4-hexadiene (1,4-HD) and dicyclopentadiene (DCP).

The EPDMs include those of an oil-extension type having flexibility controlled by addition of an extension oil, and those of a non-oil-extension type containing no extension oil. In the present invention, the EPDM of the non-oil-extension type is used for prevention of the contamination of the photoreceptor body.

These EPDMs may be used either alone or in combination.

Particularly, an EPDM of the non-oil-extension type and a higher diene content ENB type having a Mooney viscosity ML(1+4) of not greater than 50 at 100° C. is preferred.

Examples of the EPDM satisfying these conditions include ESPRENE (registered trade name) 505A (having a diene content of 9.5% and a Mooney viscosity ML(1+4) of 47 at 100° C.) available from Sumitomo Chemical Co., Ltd., and MITSUI EPT X-4010M (having a diene content of 7.6% and a Mooney viscosity ML(1+4) of 8 at 100° C.) and 4021 (having a diene content of 8.1% and a Mooney viscosity ML(1+4) of 24 at 100° C.) available from Mitsui Chemicals, Inc, which may be used either alone or in combination.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. In the present invention, the NBR of the non-oil-extension type is used for prevention of the contamination of the photoreceptor body.

These NBRs may be used either alone or in combination.

Particularly, a lower acrylonitrile content NBR (having an acrylonitrile content of less than 25%) or an intermediate acrylonitrile content NBR (having an acrylonitrile content of less than 30%) having a Mooney viscosity ML(1+4) of not greater than 65 at 100° C. is preferred.

Examples of the NBR satisfying these conditions include JSR (registered trade name) N250SL, N250S, N260S, N240S, N241 and N242S available from JSR Co., Ltd, which may be used either alone or in combination.

(SBR)

Usable as the SBR are various SBRs synthesized by copolymerizing styrene and 1,3-butadiene by an emulsion polymerization method, a solution polymerization method and other various polymerization methods.

According to the styrene content, the SBRs are classified into a higher styrene content type, an intermediate styrene content type and a lower styrene content type, and any of these types of SBRs is usable.

The SBRs include those of an oil-extension type having flexibility controlled by addition of an extension oil, and those of a non-oil-extension type containing no extension oil. In the present invention, the SBR of the non-oil-extension type is used for prevention of the contamination of the photoreceptor body.

These SBRs may be used either alone or in combination.

Particularly, a cold non-oil-extension type SBR having a Mooney viscosity ML(1+4) of not greater than 60 at 100° C. is preferred.

Examples of the SBR satisfying these conditions include JSR 1500 (having a Mooney viscosity ML(1+4) of 52 at 100° C.), JSR 1502 (having a Mooney viscosity ML(1+4) of 52 at 100° C.) and JSR 1507 (having a Mooney viscosity ML(1+4) of 35 at 100° C.) available from JSR Co., Ltd, which may be used either alone or in combination.

(Blending Proportions)

The proportion of the EPDM of the rubber component to be blended should be not less than 10 parts by mass and not greater than 70 parts by mass based on 100 parts by mass of the overall rubber component.

If the proportion of the EPDM is less than the aforementioned range, the sulfur highly compatible with the EPDM cannot be sufficiently mixed in the electrically conductive rubber composition, so that the resulting developing roller is liable to have a greater compression set or contaminate the photoreceptor body.

If the proportion of the EPDM is greater than the aforementioned range, on the other hand, a lower molecular weight component of the EPDM is liable to bleed on the resulting developing roller to thereby adversely contaminate the photoreceptor body. Further, the developing roller is liable to become less flexible, thereby suffering from reduction in the imaging durability.

Where the proportion of the EPDM falls within the aforementioned range, in contrast, it is possible to minimize the compression set of the developing roller while preventing the contamination of the photoreceptor body and the reduction in the flexibility of the developing roller.

For further improvement of these effects, the proportion of the EPDM is preferably not less than 30 parts by mass in the aforementioned range based on 100 parts by mass of the overall rubber component.

The proportions of the NBR and/or the SBR may be properly determined. Where the two-rubber combination of the EPDM and the NBR is employed as the rubber component, the proportion of the NBR is a balance obtained by subtracting the proportion of the EPDM from the total. That is, the proportion of the NBR is not less than 30 parts by mass and not greater than 90 parts by mass, particularly preferably not greater than 70 parts by mass, based on 100 parts by mass of the overall rubber component.

Similarly, where the two-rubber combination of the EPDM and the SBR is employed as the rubber component, the proportion of the SBR is a balance obtained by subtracting the proportion of the EPDM from the total. That is, the proportion of the SBR is not less than 30 parts by mass and not greater than 90 parts by mass, particularly preferably not greater than 70 parts by mass, based on 100 parts by mass of the overall rubber component.

Where the three-rubber combination of the EPDM, the NBR and the SBR is employed as the rubber component, the sum of the proportions of the NBR and the SBR is a balance obtained by subtracting the proportion of the EPDM from the total. That is, the sum of the proportions of the NBR and the SBR is not less than 30 parts by mass and not greater than 90 parts by mass, particularly preferably not greater than 70 parts by mass, based on 100 parts by mass of the overall rubber component. Further, the mass ratio of the NBR to the SBR is preferably NBR/SBR=20/80 to 80/20, particularly preferably 40/60 to 60/40.

<Electron Conductive Agent>

Examples of the electron conductive agent include: electrically-conductive carbon-containing agents such as electrically conductive carbon black, carbon, carbon fibers and graphite; fine metal particles such as of silver, copper and nickel; fine metal oxide particles such as of zinc oxide, tin oxide and titanium oxide; metal fibers and whiskers such as of aluminum and stainless steel; and glass beads and synthetic fibers coated with metals. These electron conductive agents may be used either alone or in combination.

Particularly, electrically conductive carbon black is preferred. Specific examples of the electrically conductive carbon black include DENKA BLACK (registered trade name) available from Denki Kagaku Kogyo K.K., KETJEN BLACK (registered trade name) EC300J available from Lion Corporation, and HAF-, SAF- and ISAF-grade carbon blacks, which may be used either alone or in combination.

The proportion of the electrically conductive carbon black to be blended is preferably not less than 25 parts by mass and not greater than 35 parts by mass based on 100 parts by mass of the overall rubber component.

If the proportion of the electrically conductive carbon black is less than the aforementioned range, it will be impossible to impart the developing roller with proper electrical conductivity.

If the proportion of the electrically conductive carbon black is greater than the aforementioned range, on the other hand, the resulting developing roller is liable to become less flexible to have a higher hardness, thereby suffering from the reduction in the imaging durability and other problems. Further, an excess amount of the electrically conductive carbon black is liable to agglomerate, failing to evenly impart the developing roller with electrical conductivity.

Where the proportion of the electrically conductive carbon black falls within the aforementioned range, in contrast, it is possible to impart the developing roller with proper flexibility as well as proper and uniform electrical conductivity.

For further improvement of these effects, the proportion of the electrically conductive carbon black is preferably not less than 25 parts by mass and not greater than 40 parts by mass in the aforementioned range based on 100 parts by mass of the overall rubber component.

<Crosslinking Agent>

The crosslinking agent is limited to sulfur such as sulfur powder which can function as the crosslinking agent. The proportion of the sulfur to be blended should be not less than 0.5 parts by mass and not greater than 1.5 parts by mass based on 100 parts by mass of the overall rubber component.

If the proportion of the sulfur is less than the aforementioned range, the rubber component is liable to be insufficiently crosslinked, so that the resulting developing roller is liable to have a greater compression set. Further, a greater amount of an uncrosslinked lower molecular weight component is liable to bleed to contaminate the photoreceptor body.

If the proportion of the sulfur is greater than the aforementioned range, on the other hand, the rubber component is liable to be excessively crosslinked. Therefore, the resulting developing roller is liable to become less flexible to have a higher hardness, thereby suffering from reduction in the imaging durability.

Where the proportion of the sulfur falls within the aforementioned range, in contrast, it is possible to impart the developing roller with proper flexibility while preventing the contamination of the photoreceptor body and minimizing the compression set of the developing roller.

For further improvement of these effects, the proportion of the sulfur is preferably not less than 0.8 parts by mass and not greater than 1.2 parts by mass in the aforementioned range based on 100 parts by mass of the overall rubber component.

<Crosslinking Accelerating Agent>

(Thiazole Crosslinking Accelerating Agent)

Examples of the thiazole crosslinking accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (M-60-OT) and 2-(4'-morpholinodithio)benzothiazole (MDB), which can function as a crosslinking accelerating agent for the sulfur crosslinking agent. These thiazole crosslinking agents may be used either alone or in combination. Particularly, di-2-benzothiazolyl disulfide is preferred.

The proportion of the thiazole crosslinking accelerating agent should be not less than 1.0 part by mass and not greater than 2.0 parts by mass based on 100 parts by mass of the overall rubber component.

If the proportion of the thiazole crosslinking accelerating agent is less than the aforementioned range, the rubber component is liable to be insufficiently crosslinked, so that the resulting developing roller is liable to have a greater compression set. If the thiazole crosslinking accelerating agent is not blended, the rubber component is liable to be further insufficiently crosslinked, so that a greater amount of the unvulcanized lower molecular weight component is liable to bleed to contaminate the photoreceptor body.

If the proportion of the thiazole crosslinking accelerating agent is greater than the aforementioned range, on the other hand, the rubber component is liable to be excessively crosslinked, so that the developing roller is liable to become less flexible to have a higher hardness, thereby suffering from reduction in imaging durability.

Where the proportion of the thiazole crosslinking accelerating agent falls within the aforementioned range, in contrast, it is possible to impart the developing roller with proper flexibility while minimizing the compression set of the developing roller.

For further improvement of these effects, the proportion of the thiazole crosslinking accelerating agent is preferably not less than 1.3 parts by mass and not greater than 1.7 parts by mass in the aforementioned range based on 100 parts by mass of the overall rubber component.

(Tetramethylthiuram Monosulfide)

The proportion of tetramethylthiuram monosulfide (TS) to be blended as the thiuram crosslinking accelerating agent should be not less than 0.1 part by mass and not greater than 0.5 parts by mass based on 100 parts by mass of the overall rubber component.

If the proportion of tetramethylthiuram monosulfide is less than the aforementioned range, the rubber component is liable to be insufficiently crosslinked, so that the resulting developing roller is liable to have a greater compression set. If no tetramethylthiuram monosulfide is blended, the rubber component is liable to be further insufficiently crosslinked, so that a greater amount of the unvulcanized lower molecular weight component is liable to bleed to contaminate the photoreceptor body.

If the proportion of tetramethylthiuram monosulfide is greater than the aforementioned range, on the other hand, the rubber component is liable to be excessively crosslinked, so that the developing roller is liable to become less flexible to have a higher hardness, thereby suffering from reduction in imaging durability.

Where the proportion of tetramethylthiuram monosulfide falls within the aforementioned range, in contrast, it is possible to impart the developing roller with proper flexibility while minimizing the compression set of the developing roller.

For further improvement of these effects, the proportion of tetramethylthiuram monosulfide is preferably not less than 0.2 parts by mass and not greater than 0.4 parts by mass in the aforementioned range based on 100 parts by mass of the overall rubber component.

(Tetrabutylthiuram Disulfide)

The proportion of tetrabutylthiuram disulfide (TBT) to be blended as the thiuram crosslinking accelerating agent should be not less than 0.2 parts by mass and not greater than 1.5 parts by mass based on 100 parts by mass of the overall rubber component.

If the proportion of tetrabutylthiuram disulfide is less than the aforementioned range, the rubber component is liable to be insufficiently crosslinked, so that the resulting developing roller is liable to have a greater compression set. If no tetrabutylthiuram disulfide is blended, the rubber component is liable to be further insufficiently crosslinked, so that a greater amount of the unvulcanized lower molecular weight component is liable to bleed to contaminate the photoreceptor body.

If the proportion of tetrabutylthiuram disulfide is greater than the aforementioned range, on the other hand, the rubber component is liable to be excessively crosslinked, so that the developing roller is liable to become less flexible to have a higher hardness, thereby suffering from reduction in imaging durability.

Where the proportion of tetrabutylthiuram disulfide falls within the aforementioned range, in contrast, it is possible to impart the developing roller with proper flexibility while minimizing the compression set of the developing roller.

For further improvement of these effects, the proportion of tetrabutylthiuram disulfide is preferably not less than 0.4 parts by mass and not greater than 0.8 parts by mass in the aforementioned range based on 100 parts by mass of the overall rubber component.

<Other Ingredients>

In addition to the aforementioned ingredients, a crosslinking acceleration assisting agent may be blended in the inventive electrically conductive rubber component.

Examples of the crosslinking acceleration assisting agent include metal oxides such as zinc white (zinc oxide), and fatty acids such as stearic acid, oleic acid and cotton seed fatty acids, which may be used either alone or in combination.

The proportion of the crosslinking acceleration assisting agent to be blended may be properly determined according to the types and the combination of the aforementioned three rubbers of the rubber component, the proportions of the sulfur crosslinking agent and the aforementioned three crosslinking accelerating agents, or the like.

Various additives such as a filler, an anti-aging agent, an anti-oxidant, an anti-scorching agent, a pigment, a flame retarder and defoaming agent may be further blended in the inventive electrically conductive rubber composition.

Thus, a developing roller produced by extruding the inventive electrically conductive rubber composition and crosslinking the rubber component is improved in mechanical strength and durability.

The inventive electrically conductive rubber composition containing the ingredients described above can be prepared in a conventional manner. More specifically, the rubbers for the rubber component are blended in the predetermined proportions, and the resulting rubber component is simply kneaded. After additives other than the crosslinking component (sulfur, the three types of crosslinking accelerating agents and the like) are added to and kneaded with the rubber component, the crosslinking component is finally added to and further kneaded with the resulting mixture. Thus, the rubber composition is prepared.

A kneader, a Banbury mixer, an extruder or the like, for example, is usable for the kneading.

«Developing Roller»

The FIGURE is a perspective view of an exemplary developing roller according to one embodiment of the present invention.

Referring to the FIGURE, the developing roller 1 according to this embodiment includes a tubular body formed from the inventive electrically conductive rubber composition containing the aforementioned ingredients, and a shaft 3 is inserted through and fixed to a center through-hole 2 of the tubular body.

The shaft 3 is a unitary member made of a metal such as aluminum, an aluminum alloy or a stainless steel.

The shaft 3 is electrically connected to and mechanically fixed to the developing roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the developing roller 1. Thus, the shaft 3 and the developing roller 1 are unitarily rotatable.

As shown in the FIGURE on an enlarged scale, an oxide film 5 may be provided in an outer peripheral surface 4 of the developing roller 1.

The oxide film 5 thus provided functions as a dielectric layer to reduce the dielectric dissipation factor of the developing roller 1. Further, the oxide film 5 serves as a lower friction layer to suppress the adhesion of the toner, which may otherwise cause imaging failure.

In addition, the oxide film 5 can be easily formed, for example, by irradiation with ultraviolet radiation in an oxidizing atmosphere, thereby suppressing the reduction in the productivity of the developing roller 1 and the increase in production costs. However, the oxide film 5 may be obviated.

For the production of the developing roller 1, the inventive electrically conductive rubber composition preliminarily prepared is first extruded into a tubular body by means of an extruder. Then, the tubular body is cut to a predetermined length, and crosslinked in a vulcanization can by heat and pressure.

In turn, the tubular body thus crosslinked is heated in an oven for secondary crosslinking, then cooled, and polished to a predetermined outer diameter.

Various polishing methods such as dry traverse polishing method may be used for the polishing. Where the outer peripheral surface of the developing roller 1 is mirror-polished at the end of the polishing step, the releasability of the outer peripheral surface is improved and, even without the provision of the oxide film 5, the adhesion of the toner can be suppressed. In addition, the contamination of the photoreceptor body can be further effectively prevented.

Where the oxide film 5 is formed after the mirror-polishing of the outer peripheral surface as described above, the synergic effect of the mirror-polishing and the oxide film 5 further advantageously suppresses the adhesion of the toner, and further advantageously prevents the contamination of the photoreceptor body.

The shaft 3 may be inserted into and fixed to the through-hole 2 at any time between the end of the cutting of the tubular body and the end of the polishing.

However, the tubular body is preferably secondarily crosslinked and polished with the shaft 3 inserted through the through-hole 2 after the cutting. This prevents warpage and deformation of the developing roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 may be inserted through the through-hole 2 of the tubular body with the intervention of the electrically conductive thermosetting adhesive agent before the secondary crosslinking, or the shaft 3 having an outer diameter greater than the inner diameter of the through-hole 2 may be press-inserted into the through-hole 2.

In the former case, the thermosetting adhesive agent is cured when the tubular body is secondarily crosslinked by the heating in the oven. Thus, the shaft 3 is electrically connected to and mechanically fixed to the developing roller 1.

In the latter case, the electrical connection and the mechanical fixing are achieved simultaneously with the press insertion.

As described above, the formation of the oxide film 5 is preferably achieved by the irradiation of the outer peripheral surface 4 of the developing roller 1 with the ultraviolet radiation, because this method is simple and efficient. That is, the formation of the oxide film 5 is achieved by irradiating a part of the electrically conductive rubber composition present in the outer peripheral surface 4 of the developing roller 1 with ultraviolet radiation having a predetermined wavelength for a predetermined period to oxidize the irradiated part of the electrically conductive rubber composition.

Since the formation of the oxide film 5 is achieved through the oxidation of the part of the electrically conductive rubber composition present in the outer peripheral surface 4 of the developing roller 1 by the irradiation with the ultraviolet radiation as described above, the resulting oxide film 5 is free from contamination with foreign matter, an uneven thickness and other problems associated with a conventional film formation method in which a coating film is formed by applying a coating agent, and is highly uniform in thickness and surface geometry.

The wavelength of the ultraviolet radiation to be used for the irradiation is preferably not less than 100 nm and not greater than 400 nm, particularly preferably not greater than 300 nm, for efficient oxidation of the electrically conductive rubber composition and for the formation of the oxide film 5 excellent in the aforementioned functions. The irradiation period is preferably not shorter than 30 seconds and not longer than 30 minutes, particularly preferably not shorter than 1 minute and not longer than 15 minutes.

The oxide film 5 may be formed by other method, or may be obviated in some case.

The inventive developing roller 1 may have a double layer structure which includes an outer layer provided on the side of the outer peripheral surface 4 and an inner layer provided on the side of the shaft 3. In this case, at least the outer layer is formed from the inventive electrically conductive rubber composition. Further, the developing roller 1 may have a porous structure.

However, the developing roller 1 preferably has a nonporous single-layer structure (excluding the oxide film 5) for simplification of the structure, for improvement of abrasion resistance, and for minimization of the compression set.

The inventive developing roller 1 having the nonporous single-layer structure preferably has a Type-A durometer hardness of not greater than 60.

If the Type-A durometer hardness is greater than the aforementioned range, the developing roller 1 is liable to have an insufficient flexibility and hence a higher hardness. This makes it impossible to provide a sufficient nip width for improvement of the toner developing efficiency, and to reduce the damage to the toner for improvement of the imaging durability.

The developing roller 1 having the nonporous single-layer structure preferably has a compression set of not greater than 10%.

If the compression set is greater than the aforementioned range, a compressed part of the developing roller 1 is liable to be permanently compressively deformed, thereby resulting in imaging failure such as uneven image.

The inventive developing roller 1 is advantageously used, for example, in an electrophotographic image forming apparatuses such as a laser printer, an electrostatic copying machine, a plain paper facsimile machine and a printer-copier-facsimile multifunction machine.

EXAMPLES

Example 1

(Preparation of Electrically Conductive Rubber Composition)

A rubber component was prepared by blending 40 parts by mass of an EPDM (non-oil extension type EPDM, ESPRENE (registered trade name) 505A available from Sumitomo Chemical Co., Ltd., and having an ethylene content of 50% and a diene content of 9.5%) and 60 parts by mass of an NBR (lower-acrylonitrile-content and non-oil-extension type NBR, JSR (registered trade name) N250SL available from JSR Co., Ltd. and having an acrylonitrile content of 19.5%). The proportion of the EPDM was 40 parts by mass based on 100 parts by mass of the overall rubber component.

While 100 parts by mass of the rubber component was simply kneaded by means of a Banbury mixer, 25 parts by mass of electrically conductive carbon black (SEAST 3 available from Tokai Carbon Co., Ltd.) was added to and kneaded with the rubber component.

While the resulting mixture was continuously kneaded, 1.00 part by mass of sulfur powder (crosslinking agent), 1.50 parts by mass of di-2-benzothiazolyl disulfide (thiazole crosslinking accelerating agent, NOCCELER (registered trade name) DM available from Ouchi Shinko Chemical Industrial Co., Ltd.), 0.30 parts by mass of tetramethylthiuram monosulfide (thiuram crosslinking accelerating agent, NOCCELER TS available from Ouchi Shinko Chemical Industrial Co., Ltd.), 0.60 parts by mass of tetrabutylthiuram disulfide (thiuram crosslinking accelerating agent, NOCCELER TBT-n available from Ouchi Shinko Chemical Industrial Co., Ltd.) and 5 parts by mass of zinc white (crosslinking acceleration assisting agent, zinc oxide Type-2 available from Mitsui Mining & Smelting Co., Ltd.) were added to the mixture. Then, the resulting mixture was further kneaded. Thus, an electrically conductive rubber composition was prepared.

(Production of Developing Roller)

The rubber composition thus prepared was fed into an extruder, and extruded into a cylindrical tubular body having an outer diameter of 22 mm and an inner diameter of 9 to 9.5 mm. Then, the tubular body was fitted around a temporary crosslinking shaft having an outer diameter of 8 mm, and crosslinked in a vulcanization can at 160° C. for 1 hour.

Then, the crosslinked tubular body was removed from the temporary shaft, then fitted around a metal shaft having an outer diameter of 10 mm and an outer peripheral surface to which an electrically conductive thermosetting adhesive agent was applied, and heated to 160° C. in an oven. Thus, the tubular body was bonded to the shaft. In turn, opposite end portions of the tubular body were cut, and the outer peripheral surface of the resulting tubular body was polished by a traverse polishing method by means of a cylindrical polishing machine and then mirror-polished.

Subsequently, the polished outer peripheral surface of the tubular body was rinsed with water, and the tubular body was set in a UV irradiation apparatus (PL21-200 available from Sen Lights Corporation) with its outer peripheral surface spaced 10 cm from a UV lamp. Then, the tubular body was rotated about the shaft by 90 degrees at each time, and each 90-degree angular range of the outer peripheral surface was irradiated with ultraviolet radiation at wavelengths of 184.9 nm and 253.7 nm for 3.75 minutes. Thus, the outer peripheral surface was entirely irradiated with the ultraviolet radiation for 15 minutes, whereby an oxide film was formed in the entire outer peripheral surface. In this manner, the developing roller was produced.

Example 2

An electrically conductive rubber composition was prepared in substantially the same manner as in Example 1, except that the proportion of the EPDM was 10 parts by mass and the proportion of the NBR was 90 parts by mass. Then, a developing roller was produced by using the electrically conductive rubber composition thus prepared. The proportion of the EPDM was 10 parts by mass based on 100 parts by mass of the overall rubber component.

Example 3

An electrically conductive rubber composition was prepared in substantially the same manner as in Example 1, except that the proportion of the EPDM was 70 parts by mass and the proportion of the NBR was 30 parts by mass. Then, a developing roller was produced by using the electrically conductive rubber composition thus prepared. The proportion of the EPDM was 70 parts by mass based on 100 parts by mass of the overall rubber component.

Example 4

An electrically conductive rubber composition was prepared in substantially the same manner as in Example 1, except that an SBR (non-oil-extension type SBR, JSR1502 available from JSR Co., Ltd. and having a styrene content of 23.5%) was blended instead of the NBR in the same proportion. Then, a developing roller was produced by using the electrically conductive rubber composition thus prepared. The proportion of the EPDM was 40 parts by mass based on 100 parts by mass of the overall rubber component.

Example 5

An electrically conductive rubber composition was prepared in substantially the same manner as in Example 1, except that the proportion of the NBR was 30 parts by mass and an SBR (non-oil-extension type SBR, JSR1502 available from JSR Co., Ltd. and having a styrene content of 23.5%) was additionally blended in a proportion of 30 parts by mass. Then, a developing roller was produced by using the electrically conductive rubber composition thus prepared. The proportion of the EPDM was 40 parts by mass based on 100 parts by mass of the overall rubber component. The mass ratio between the NBR and the SBR was NBR/SBR=50/50.

Example 6

An electrically conductive rubber composition was prepared in substantially the same manner as in Example 5, except that the proportion of the EPDM was 10 parts by mass, the proportion of the NBR was 45 parts by mass, and the proportion of the SBR was 45 parts by mass. Then, a developing roller was produced by using the electrically conductive rubber composition thus prepared. The proportion of the EPDM was 10 parts by mass based on 100 parts by mass of the overall rubber component. The mass ratio between the NBR and the SBR was NBR/SBR=50/50.

Example 7

An electrically conductive rubber composition was prepared in substantially the same manner as in Example 5, except that the proportion of the EPDM was 70 parts by mass, the proportion of the NBR was 15 parts by mass, and the proportion of the SBR was 15 parts by mass. Then, a developing roller was produced by using the electrically conductive rubber composition thus prepared. The proportion of the EPDM was 70 parts by mass based on 100 parts by mass of the overall rubber component. The mass ratio between the NBR and the SBR was NBR/SBR=50/50.

Comparative Example 1

An electrically conductive rubber composition was prepared in substantially the same manner as in Example 1, except that the proportion of the EPDM was 5 parts by mass and the proportion of the NBR was 95 parts by mass. Then, a developing roller was produced by using the electrically conductive rubber composition thus prepared. The proportion of the EPDM was 5 parts by mass based on 100 parts by mass of the overall rubber component.

Comparative Example 2

An electrically conductive rubber composition was prepared in substantially the same manner as in Example 1, except that the proportion of the EPDM was 75 parts by mass and the proportion of the NBR was 25 parts by mass. Then, a developing roller was produced by using the electrically conductive rubber composition thus prepared. The proportion of the EPDM was 75 parts by mass based on 100 parts by mass of the overall rubber component.

Examples 8, 9 and Comparative Examples 3, 4

Electrically conductive rubber compositions were prepared in substantially the same manner as in Example 1, except that the proportions of the sulfur were 0.40 parts by mass (Comparative Example 3), 0.50 parts by mass (Example 8), 1.50 parts by mass (Example 9) and 1.60 parts by mass (Comparative Example 4) based on 100 parts by mass of the overall rubber component. Then, developing rollers were respectively produced by using the electrically conductive rubber compositions thus prepared.

Examples 10, 11 and Comparative Examples 5, 6

Electrically conductive rubber compositions were prepared in substantially the same manner as in Example 1, except that the proportions of the di-2-benzothiazolyl disulfide were 0.90 parts by mass (Comparative Example 5), 1.00 part by mass (Example 10), 2.00 parts by mass (Example 11) and 2.10 parts by mass (Comparative Example 6) based on 100 parts by mass of the overall rubber component. Then, developing rollers were respectively produced by using the electrically conductive rubber compositions thus prepared.

Examples 12, 13 and Comparative Examples 7, 8

Electrically conductive rubber compositions were prepared in substantially the same manner as in Example 1, except that the proportions of the tetramethylthiuram monosulfide were 0.05 parts by mass (Comparative Example 7), 0.10 part by mass (Example 12), 0.50 parts by mass (Example 13) and 0.55 parts by mass (Comparative Example 8) based on 100 parts by mass of the overall rubber component. Then, developing rollers were respectively produced by using the electrically conductive rubber compositions thus prepared.

Examples 14, 15 and Comparative Examples 9, 10

Electrically conductive rubber compositions were prepared in substantially the same manner as in Example 1, except that the proportions of the tetrabutylthiuram disulfide were 0.10 part by mass (Comparative Example 9), 0.20 parts by mass (Example 14), 1.50 parts by mass (Example 15) and 1.60 parts by mass (Comparative Example 10) based on 100 parts by mass of the overall rubber component. Then, developing rollers were respectively produced by using the electrically conductive rubber compositions thus prepared.

Comparative Example 11

An electrically conductive rubber composition was prepared in substantially the same manner as in Example 1, except that no di-2-benzothiazolyl disulfide was blended. Then, a developing roller was produced by using the electrically conductive rubber composition thus prepared.

Comparative Example 12

An electrically conductive rubber composition was prepared in substantially the same manner as in Example 1, except that no tetramethylthiuram monosulfide was blended. Then, a developing roller was produced by using the electrically conductive rubber composition thus prepared.

Comparative Example 13

An electrically conductive rubber composition was prepared in substantially the same manner as in Example 1, except that no tetrabutylthiuram disulfide was blended. Then, a developing roller was produced by using the electrically conductive rubber composition thus prepared.

<Type-A Durometer Hardness>

The type-A durometer hardness of each of the developing rollers of Examples and Comparative Examples was measured at a temperature of 23±1° C. in conformity with Japanese Industrial Standards JIS $K6253_{:2006}$ "Rubber, vulcanized or thermoplastic—Determination of hardness" by means of an Asker durometer type-A (available from Kobunshi Keiki Co., Ltd.) specified in JIS K6253.

A developing roller having a type-A durometer hardness of not greater than 60 was rated as acceptable (○), and a developing roller having a type-A durometer hardness of greater than 60 was rated as unacceptable (x).

<Compression Set Percentage>

Small test pieces specified in Japanese Industrial Standards JIS $K6262_{:2006}$ "Rubber, vulcanized or thermoplastic—Determination of compression set at ambient, elevated or low temperatures" were respectively produced by cross-linking the electrically conductive rubber compositions of Examples and Comparative Examples under the same conditions as for the production of the developing rollers. Then, the compression set percentage of each of the small test pieces thus produced was measured in conformity with JIS $K6262_{:2006}$.

More specifically, a compressive strain was applied to the small test piece by compressing the test piece to a depth of 25% of the original thickness $t_0$ (mm) of the test piece, and the test piece was maintained in the compressed state at a temperature of 70±1° C. for 22 hours. Then, the small test piece was released from the compressed state and, after the test piece was allowed to stand still at a room temperature for 30 minutes, the thickness $t_2$ (mm) of the test piece was measured.

The compression set percentage Cs (%) was calculated from the following expression (1):

$$Cs\ (\%)=(t_0-t_2)/(t_0-t_1)\times 100 \quad (1)$$

wherein $t_1$ (mm) is the thickness of a spacer used when the compressive strain was applied to the test piece.

A test piece having a compression set percentage of not greater than 10% was rated as acceptable (○), and a test piece having a compression set percentage of greater than 10% was rated as unacceptable (x).

<Storage Test>

The developing rollers of Examples and Comparative Examples were each incorporated instead of an original developing roller in a commercially available cartridge for a laser printer, and the resulting cartridge was allowed to stand still in a higher temperature and higher humidity environment at a temperature of 50° C. at a relative humidity of 90% for one week. Thereafter, the cartridge was mounted in the laser printer, and an image forming operation was performed. Then, it was checked whether a contamination line was formed on a portion of the photoreceptor body which had been kept in contact with the developing roller during the stand-still period.

A developing roller free from the formation of the contamination line was rated as acceptable (○) without the imaging failure attributable to the contamination of the photoreceptor body, and a developing roller suffering from the formation of the contamination line was rated as unacceptable (x) with the imaging failure attributable to the contamination of the photoreceptor body.

The above results are shown in Tables 1 and 6.

TABLE 1

| | | Comparative Example 1 | Example 2 | Example 1 | Example 3 | Comparative Example 2 |
|---|---|---|---|---|---|---|
| | | Parts by mass | | | | |
| EPDM | | 5 | 10 | 40 | 70 | 75 |
| NBR | | 95 | 90 | 60 | 30 | 25 |
| SBR | | — | — | — | — | — |
| Sulfur | | 1.00 | 1.00 | 1.00 | 1.00 | 1.00 |
| Accelerating agent DM | | 1.50 | 1.50 | 1.50 | 1.50 | 1.50 |
| Accelerating agent TS | | 0.30 | 0.30 | 0.30 | 0.30 | 0.30 |
| Accelerating agent TBT-n | | 0.60 | 0.60 | 0.60 | 0.60 | 0.60 |
| | | Evaluation | | | | |
| Type-A hardness | Value | 50 | 51 | 55 | 56 | 58 |
| | Evaluation | ○ | ○ | ○ | ○ | ○ |
| Compression set | Percentage (%) | 10.8 | 9.5 | 8.8 | 8.1 | 7.5 |
| | Evaluation | x | ○ | ○ | ○ | ○ |
| Contamination of photoreceptor | | ○ | ○ | ○ | ○ | x |

TABLE 2

| | Example 4 | Example 5 | Example 6 | Example 7 |
|---|---|---|---|---|
| Parts by mass | | | | |
| EPDM | 40 | 40 | 10 | 70 |
| NBR | — | 30 | 45 | 15 |
| SBR | 60 | 30 | 45 | 15 |
| Sulfur | 1.00 | 1.00 | 1.00 | 1.00 |
| Accelerating agent DM | 1.50 | 1.50 | 1.50 | 1.50 |
| Accelerating agent TS | 0.30 | 0.30 | 0.30 | 0.30 |
| Accelerating agent TBT-n | 0.60 | 0.60 | 0.60 | 0.60 |

TABLE 2-continued

| | | Example 4 | Example 5 | Example 6 | Example 7 |
|---|---|---|---|---|---|
| Evaluation | | | | | |
| Type-A hardness | Value | 53 | 55 | 50 | 59 |
| | Evaluation | ○ | ○ | ○ | ○ |
| Compression set | Percentage (%) | 8.4 | 7.2 | 9.5 | 6.8 |
| | Evaluation | ○ | ○ | ○ | ○ |
| Contamination of photoreceptor | | ○ | ○ | ○ | ○ |

TABLE 3

| | | Comparative Example 3 | Example 8 | Example 1 | Example 9 | Comparative Example 4 |
|---|---|---|---|---|---|---|
| Parts by mass | | | | | | |
| EPDM | | 40 | 40 | 40 | 40 | 40 |
| NBR | | 60 | 60 | 60 | 60 | 60 |
| SBR | | — | — | — | — | — |
| Sulfur | | 0.40 | 0.50 | 1.00 | 1.50 | 1.60 |
| Accelerating agent DM | | 1.50 | 1.50 | 1.50 | 1.50 | 1.50 |
| Accelerating agent TS | | 0.30 | 0.30 | 0.30 | 0.30 | 0.30 |
| Accelerating agent TBT-n | | 0.60 | 0.60 | 0.60 | 0.60 | 0.60 |
| Evaluation | | | | | | |
| Type-A hardness | Value | 49 | 50 | 55 | 59 | 61 |
| | Evaluation | ○ | ○ | ○ | ○ | x |
| Compression set | Percentage (%) | 11.8 | 9.8 | 8.8 | 7.5 | 6.8 |
| | Evaluation | x | ○ | ○ | ○ | ○ |
| Contamination of photoreceptor | | x | ○ | ○ | ○ | ○ |

TABLE 4

| | | Comparative Example 11 | Comparative Example 5 | Example 10 | Example 1 | Example 11 | Comparative Example 6 |
|---|---|---|---|---|---|---|---|
| Parts by mass | | | | | | | |
| EPDM | | 40 | 40 | 40 | 40 | 40 | 40 |
| NBR | | 60 | 60 | 60 | 60 | 60 | 60 |
| SBR | | — | — | — | — | — | — |
| Sulfur | | 1.00 | 1.00 | 1.00 | 1.00 | 1.00 | 1.00 |
| Accelerating agent DM | | — | 0.90 | 1.00 | 1.50 | 2.00 | 2.10 |
| Accelerating agent TS | | 0.30 | 0.30 | 0.30 | 0.30 | 0.30 | 0.30 |
| Accelerating agent TBT-n | | 0.60 | 0.60 | 0.60 | 0.60 | 0.60 | 0.60 |
| Evaluation | | | | | | | |
| Type-A hardness | Value | 52 | 51 | 52 | 55 | 58 | 61 |
| | Evaluation | ○ | ○ | ○ | ○ | ○ | x |
| Compression set | Percentage (%) | 10.8 | 10.5 | 9.1 | 8.8 | 8.1 | 7.9 |
| | Evaluation | x | x | ○ | ○ | ○ | ○ |
| Contamination of photoreceptor | | x | ○ | ○ | ○ | ○ | ○ |

TABLE 5

| | Comparative Example 12 | Comparative Example 7 | Example 12 | Example 1 | Example 13 | Comparative Example 8 |
|---|---|---|---|---|---|---|
| Parts by mass | | | | | | |
| EPDM | 40 | 40 | 40 | 40 | 40 | 40 |
| NBR | 60 | 60 | 60 | 60 | 60 | 60 |
| SBR | — | — | — | — | — | — |
| Sulfur | 1.00 | 1.00 | 1.00 | 1.00 | 1.00 | 1.00 |
| Accelerating agent DM | 1.50 | 1.50 | 1.50 | 1.50 | 1.50 | 1.50 |
| Accelerating agent TS | — | 0.05 | 0.10 | 0.30 | 0.50 | 0.55 |
| Accelerating agent TBT-n | 0.60 | 0.60 | 0.60 | 0.60 | 0.60 | 0.60 |

TABLE 5-continued

| | | Comparative Example 12 | Comparative Example 7 | Example 12 | Example 1 | Example 13 | Comparative Example 8 |
|---|---|---|---|---|---|---|---|
| | | | | Evaluation | | | |
| Type-A hardness | Value | 51 | 50 | 51 | 55 | 59 | 61 |
| | Evaluation | ○ | ○ | ○ | ○ | ○ | x |
| Compression set | Percentage (%) | 13.5 | 10.6 | 9.5 | 8.8 | 7.1 | 6.9 |
| | Evaluation | x | x | ○ | ○ | ○ | ○ |
| Contamination of photoreceptor | | x | ○ | ○ | ○ | ○ | ○ |

TABLE 6

| | | Comparative Example 13 | Comparative Example 9 | Example 14 | Example 1 | Example 15 | Comparative Example 10 |
|---|---|---|---|---|---|---|---|
| | | | | Parts by mass | | | |
| EPDM | | 40 | 40 | 40 | 40 | 40 | 40 |
| NBR | | 60 | 60 | 60 | 60 | 60 | 60 |
| SBR | | — | — | — | — | — | — |
| Sulfur | | 1.00 | 1.00 | 1.00 | 1.00 | 1.00 | 1.00 |
| Accelerating agent DM | | 1.50 | 1.50 | 1.50 | 1.50 | 1.50 | 1.50 |
| Accelerating agent TS | | 0.30 | 0.30 | 0.30 | 0.30 | 0.30 | 0.30 |
| Accelerating agent TBT-n | | — | 0.10 | 0.20 | 0.60 | 1.50 | 1.60 |
| | | | | Evaluation | | | |
| Type-A hardness | Value | 52 | 50 | 52 | 55 | 58 | 61 |
| | Evaluation | ○ | ○ | ○ | ○ | ○ | x |
| Compression set | Percentage (%) | 11.5 | 10.5 | 8.9 | 8.8 | 7.2 | 6.9 |
| | Evaluation | x | x | ○ | ○ | ○ | ○ |
| Contamination of photoreceptor | | x | ○ | ○ | ○ | ○ | ○ |

The results for Examples 1 to 7 and Comparative Examples 1, 2 shown in Tables 1 and 2 indicate that two or three types of rubbers including the EPDM and the NBR and/or the SBR should be used in combination as the rubber component, and the proportion of the EPDM to be used in combination with the NBR and/or the SBR should be not less than 10 parts by mass and not greater than 70 parts by mass, particularly preferably not less than 30 parts by mass, based on 100 parts by mass of the overall rubber component in order to impart the developing roller formed from the rubber composition of the electron conductive type with proper electrical conductivity while preventing the increase in the compression set of the developing roller and the contamination of the photoreceptor body.

The results for Examples 1, 8, 9 and Comparative Examples 3, 4 shown in Table 3 indicate that the proportion of the sulfur should be not less than 0.5 parts by mass and not greater than 1.5 parts by mass, particularly preferably not less than 0.8 parts by mass and not greater than 1.2 parts by mass, based on 100 parts by mass of the overall rubber component in order to provide the aforementioned effects.

The results for Examples 1, 10, 11 and Comparative Examples 5, 6, 11 shown in Table 4 indicate that the proportion of the thiazole crosslinking accelerating agent should be not less than 1.0 part by mass and not greater than 2.0 parts by mass, particularly preferably not less than 1.3 parts by mass and not greater than 1.7 parts by mass, based on 100 parts by mass of the overall rubber component.

The results for Examples 1, 12, 13 and Comparative Examples 7, 8, 12 shown in Table 5 indicate that the proportion of the tetramethylthiuram monosulfide should be not less than 1.0 part by mass and not greater than 0.5 parts by mass, particularly preferably not less than 0.2 parts by mass and not greater than 0.4 parts by mass, based on 100 parts by mass of the overall rubber component.

The results for Examples 1, 14, 15 and Comparative Examples 9, 10, 13 shown in Table 6 indicate that the proportion of the tetrabutylthiuram disulfide should be not less than 0.2 parts by mass and not greater than 1.5 parts by mass, particularly preferably not less than 0.4 parts by mass and not greater than 0.8 parts by mass, based on 100 parts by mass of the overall rubber component.

This application corresponds to Japanese Patent Application No. 2014-189057 filed in the Japan Patent Office on Sep. 17, 2014, the disclosure of which is incorporated herein by reference in its entirety.

What is claimed is:

1. An electrically conductive rubber composition comprising:

a rubber component;

an electron conductive agent;

sulfur as a crosslinking agent; and a crosslinking accelerating agent;

wherein the rubber component consists of an ethylene propylene diene rubber, an acrylonitrile butadiene rubber and a styrene butadiene rubber;

wherein the rubber component does not include an epichlorohydrin rubber;

wherein the ethylene propylene diene rubber is present in a proportion of not less than 10 parts by mass and not greater than 70 parts by mass based on 100 parts by mass of the overall rubber component;

wherein the sulfur is present in a proportion of not less than 0.5 parts by mass and not greater than 1.5 parts by mass based on 100 parts by mass of the overall rubber component;

wherein the crosslinking accelerating agent includes not less than 1.0 part by mass and not greater than 2.0 parts by mass of a thiazole crosslinking accelerating agent, not less than 0.1 part by mass and not greater than 0.5 parts by mass of tetramethylthiuram monosulfide, and not less than 0.2 parts by mass and not greater than 1.5 parts by mass of tetrabutylthiuram disulfide based on 100 parts by mass of the overall rubber component.

2. A developing roller comprising a crosslinking product of the electrically conductive rubber composition according to claim 1.

3. The electrically conductive rubber composition according to claim 1, wherein the electron conductive agent includes an electrically conductive carbon black.

4. The electrically conductive rubber composition according to claim 3, wherein the proportion of the electrically conductive carbon black to be blended is not less than 25 parts by mass and not greater than 35 parts by mass based on 100 parts by mass of the overall rubber component.

5. An electrically conductive rubber composition comprising:

a rubber component;

an electron conductive agent;

sulfur as a crosslinking agent; and a crosslinking accelerating agent;

wherein the rubber component consists of an ethylene propylene diene rubber and acrylonitrile butadiene rubber;

wherein the rubber component does not include an epichlorohydrin rubber;

wherein the ethylene propylene diene rubber is present in a proportion of not less than 10 parts by mass and not greater than 70 parts by mass based on 100 parts by mass of the overall rubber component;

wherein the sulfur is present in a proportion of not less than 0.5 parts by mass and not greater than 1.5 parts by mass based on 100 parts by mass of the overall rubber component;

wherein the crosslinking accelerating agent includes not less than 1.0 part by mass and not greater than 2.0 parts by mass of a thiazole crosslinking accelerating agent, not less than 0.1 part by mass and not greater than 0.5 parts by mass of tetramethylthiuram monosulfide, and not less than 0.2 parts by mass and not greater than 1.5 parts by mass of tetrabutylthiuram disulfide based on 100 parts by mass of the overall rubber component.

6. The electrically conductive rubber composition according to claim 5, wherein the acrylonitrile butadiene rubber is present in a proportion of not less than 30 parts by mass and not greater than 90 parts by mass based on 100 parts by mass of the overall rubber component.

7. The electrically conductive rubber composition according to claim 5, wherein the electron conductive agent includes an electrically conductive carbon black.

8. The electrically conductive rubber composition according to claim 7, wherein the proportion of the electrically conductive carbon black to be blended is not less than 25 parts by mass and not greater than 35 parts by mass based on 100 parts by mass of the overall rubber component.

9. An electrically conductive rubber composition comprising:

a rubber component;

an electron conductive agent;

sulfur as a crosslinking agent; and a crosslinking accelerating agent;

wherein the rubber component consists of an ethylene propylene diene rubber and a styrene butadiene rubber;

wherein the rubber component does not include an epichlorohydrin rubber;

wherein the ethylene propylene diene rubber is present in a proportion of not less than 10 parts by mass and not greater than 70 parts by mass based on 100 parts by mass of the overall rubber component;

wherein the sulfur is present in a proportion of not less than 0.5 parts by mass and not greater than 1.5 parts by mass based on 100 parts by mass of the overall rubber component;

wherein the crosslinking accelerating agent includes not less than 1.0 part by mass and not greater than 2.0 parts by mass of a thiazole crosslinking accelerating agent, not less than 0.1 part by mass and not greater than 0.5 parts by mass of tetramethylthiuram monosulfide, and not less than 0.2 parts by mass and not greater than 1.5 parts by mass of tetrabutylthiuram disulfide based on 100 parts by mass of the overall rubber component.

10. The electrically conductive rubber composition according to claim 9, wherein the styrene butadiene rubber is present in a proportion of not less than 30 parts by mass and not greater than 90 parts by mass based on 100 parts by mass of the overall rubber component.

11. The electrically conductive rubber composition according to claim 9, wherein the electron conductive agent includes an electrically conductive carbon black.

12. The electrically conductive rubber composition according to claim 11, wherein the proportion of the electrically conductive carbon black to be blended is not less than 25 parts by mass and not greater than 35 parts by mass based on 100 parts by mass of the overall rubber component.

* * * * *